US007878587B1

(12) United States Patent
Leach

(10) Patent No.: US 7,878,587 B1
(45) Date of Patent: Feb. 1, 2011

(54) SEAT LINER FOR A CHILD'S SEAT

(76) Inventor: Jamie S. Leach, P.O. Box 717, Ada, OK (US) 74821-0717

( * ) Notice: Subject to any disclaimer, the term of this patent is extended or adjusted under 35 U.S.C. 154(b) by 114 days.

(21) Appl. No.: 12/186,949

(22) Filed: Aug. 6, 2008

(51) Int. Cl.
*A47D 13/08* (2006.01)

(52) U.S. Cl. ..... 297/219.12; 297/256.17; 297/485

(58) Field of Classification Search ..... 297/219.12, 297/256.17, 467, 485
See application file for complete search history.

(56) References Cited

U.S. PATENT DOCUMENTS

| | | | | |
|---|---|---|---|---|
| 4,037,764 | A | 7/1977 | Almosnino et al. | |
| 4,093,307 | A * | 6/1978 | McLennan | 297/485 |
| 4,117,840 | A | 10/1978 | Rasure | |
| 4,170,991 | A | 10/1979 | Kella | |
| 4,235,474 | A | 11/1980 | Rosenberg | |
| 4,568,125 | A * | 2/1986 | Sckolnik | 297/467 |
| 4,601,065 | A | 7/1986 | Sigl et al. | |
| 4,639,946 | A | 2/1987 | Koenig | |
| 4,666,207 | A * | 5/1987 | Quartano | 297/229 |
| 4,793,004 | A | 12/1988 | Long et al. | |
| 4,834,459 | A | 5/1989 | Leach | |
| 4,861,109 | A | 8/1989 | Leach | |
| 4,871,210 | A | 10/1989 | Alexander et al. | |
| D309,018 | S | 7/1990 | Leach | |
| 4,939,824 | A | 7/1990 | Reed | |
| 5,056,869 | A | 10/1991 | Morrison | |
| 5,103,514 | A | 4/1992 | Leach | |
| 5,233,714 | A | 8/1993 | De Bell Daniel | |
| 5,238,293 | A * | 8/1993 | Gibson | 297/229 |
| 5,325,818 | A | 7/1994 | Leach | |
| 5,334,134 | A | 8/1994 | Saunders | |
| 5,457,820 | A | 10/1995 | Yielding | |
| D382,642 | S | 8/1997 | Van Gisbergen Rutherford | |
| 5,678,888 | A * | 10/1997 | Sowell et al. | 297/256.17 |
| 5,727,255 | A | 3/1998 | Minks | |
| 6,053,580 | A * | 4/2000 | White, Sr. | 297/467 |
| 6,095,613 | A | 8/2000 | Ostrander et al. | |

(Continued)

OTHER PUBLICATIONS

The Leachco Sit 'N Secure product, which is shown and described in the webpage attached as Exhibit 1, was in Public use and/or on sale at least as early as about May 15, 1989.

(Continued)

*Primary Examiner*—Peter R. Brown
(74) *Attorney, Agent, or Firm*—Mary M. Lee

(57) ABSTRACT

A washable seat liner for use in high chairs and grocery carts. The liner comprises a bottom panel, a back panel, left and right side panels, and a front panel. A wide body belt is attached to the inside of the back panel that encircles the child's torso like a cummerbund helping to keep the child upright and centered. The body belt includes two overlapping straps with hook-and-loop fasteners. A secondary, child-resistant connector overlies the body belt and prevents the child from releasing the body belt. A crotch connecter on the front of the liner attaches to the crotch bar on the chair or cart. This prevents the bottom of the liner from being pulled up inadvertently when the child is lifted out of the seat. A back flap wraps around the back of the seat. Side flaps have convenient pockets, and a front flap doubles as a crumb catcher.

38 Claims, 10 Drawing Sheets

U.S. PATENT DOCUMENTS

| | | | | |
|---|---|---|---|---|
| 6,142,565 | A | 11/2000 | Rieder | |
| 6,237,998 | B1 | 5/2001 | Aprile | |
| 6,247,755 | B1 | 6/2001 | Canna et al. | |
| 6,343,727 | B1 | 2/2002 | Leach | |
| 6,427,251 | B1 | 8/2002 | Leach | |
| 6,428,098 | B1 | 8/2002 | Allbaugh | |
| D465,959 | S | 11/2002 | Cameron | |
| 6,499,164 | B1 | 12/2002 | Leach | |
| 6,499,165 | B1 | 12/2002 | Morgillo | |
| 6,553,590 | B1 | 4/2003 | Leach | |
| D477,174 | S | 7/2003 | Wade | |
| 6,601,252 | B1 | 8/2003 | Leach | |
| D484,665 | S * | 12/2003 | Richardson | D34/27 |
| 6,676,210 | B1 | 1/2004 | Peyton | |
| 6,678,898 | B2 | 1/2004 | Jones et al. | |
| 6,702,381 | B2 | 3/2004 | Endicott et al. | |
| 6,751,817 | B1 | 6/2004 | Leach | |
| 6,760,934 | B1 | 7/2004 | Leach | |
| 6,764,134 | B1 | 7/2004 | Crescenzi et al. | |
| 6,817,663 | B1 | 11/2004 | Stuart | |
| 6,929,326 | B2 | 8/2005 | Cohen-Fyffe | |
| 7,003,831 | B1 | 2/2006 | Goutevenier-Reyher | |
| 7,010,821 | B1 | 3/2006 | Leach | |
| 7,073,866 | B1 | 7/2006 | Berdahl | |
| 7,114,206 | B2 | 10/2006 | Leach | |
| 7,156,458 | B2 | 1/2007 | Hanberg | |
| 7,181,789 | B2 | 2/2007 | Gatten | |
| 7,251,846 | B1 | 8/2007 | Elkin et al. | |
| 7,287,676 | B2 | 10/2007 | Chua | |
| D563,684 | S | 3/2008 | Starck | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 2005/0278864 | A1 | 12/2005 | Leach | |
| 2006/0009726 | A1 | 1/2006 | Clement | |
| 2006/0138826 | A1 | 6/2006 | Caton et al. | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0052278 | A1 | 3/2007 | Jones | |
| 2007/0151031 | A1 | 7/2007 | Leach | |
| 2007/0277321 | A1 | 12/2007 | Leach | |
| 2008/0084099 | A1 | 4/2008 | Palgon | |
| 2008/0258528 | A1 * | 10/2008 | Bush et al. | 297/256.17 |

OTHER PUBLICATIONS

The Leachco Wrap Strap product, which is shown and described in the webpage attached as Exhibit 2, was in public use and/or on sale at least as early as about Dec. 6, 1999.

The Leachco Booty Boost product, which is shown and described in the webpage attached as Exhibit 3, was in public use and/or on sale at least as early as about Sep. 10, 2004.

The Leachco Prop 'R Shopper product, which is shown and described in the webpage attached as Exhibit 4, was in public use and/or on sale at least as early as about Jul. 2004.

The Leachco Ready Wrap product, which is shown and described in the catalog page attached as Exhibit 5, was in public use and/or on sale at least as early as about Nov. 4, 1998.

The Leachco Prop 'N Pockets product, which is shown and described in the catalog page attached as Exhibit 6, was in public use and/or on sale at least as early as about Sep. 20, 1995.

The Leachco Safe Shopper Set product, which is shown and described in the catalog page attached as Exhibit 7, was in public use and/or on sale at least as early as about Mar. 13, 1995.

The Leachco Diner Liner product, which is shown and described in the packing card attached as Exhibit 8, was in public use and/or on sale at least as early as about May 10, 2004.

The Leachco Wiggle Wrap product, which is shown and described in the catalog page attached as Exhibit 9, was in public use and/or on sale at least as early as about May 10, 2004.

* cited by examiner

SEAT LINER FOR A CHILD'S SEAT

FIELD OF THE INVENTION

The present invention relates generally to seat liners for high chairs and grocery carts.

BACKGROUND OF THE INVENTION

When dining out, it is common for parents to place infants in a high chair, usually provided by the restaurant. High chairs in restaurants may be used several times a day by different babies. Babies often gum high chair lap bars, railings and seat belts. Additionally, leftover food crumbs, smears and spills often are left behind when the baby and family leave the restaurant.

Although restaurants and other food service facilities make some effort to clean the high chair before and after use, the adequacy of this cleaning may be inconsistent. Consequently, babies and toddlers occasionally may be forced to sit in a soiled seat. Moreover, even with a high chair that appears sanitary upon casual inspection, many parents remain concerned that their infant will acquire an infection from germs or dirt left behind on the high chair.

While several high chair liners are commercially available, there remains a need for improvement. There is a need for a seat liner with a wide body strap to hold a small baby in an upright position as well as secure the baby in the seat. There is a need for a seat liner with such a restraint assembly that includes a child-resistant safety buckle to deter the mischievous baby from releasing the body strap. Still further, there is a need for a seat liner that can be secured to the crotch strap of the high chair to prevent the seat liner from being pulled up when the baby is lifted out of the chair. These and other advantages are provided by the seat liner of the present invention.

DETAILED DESCRIPTION OF THE PREFERRED EMBODIMENT(S)

Figure 1:
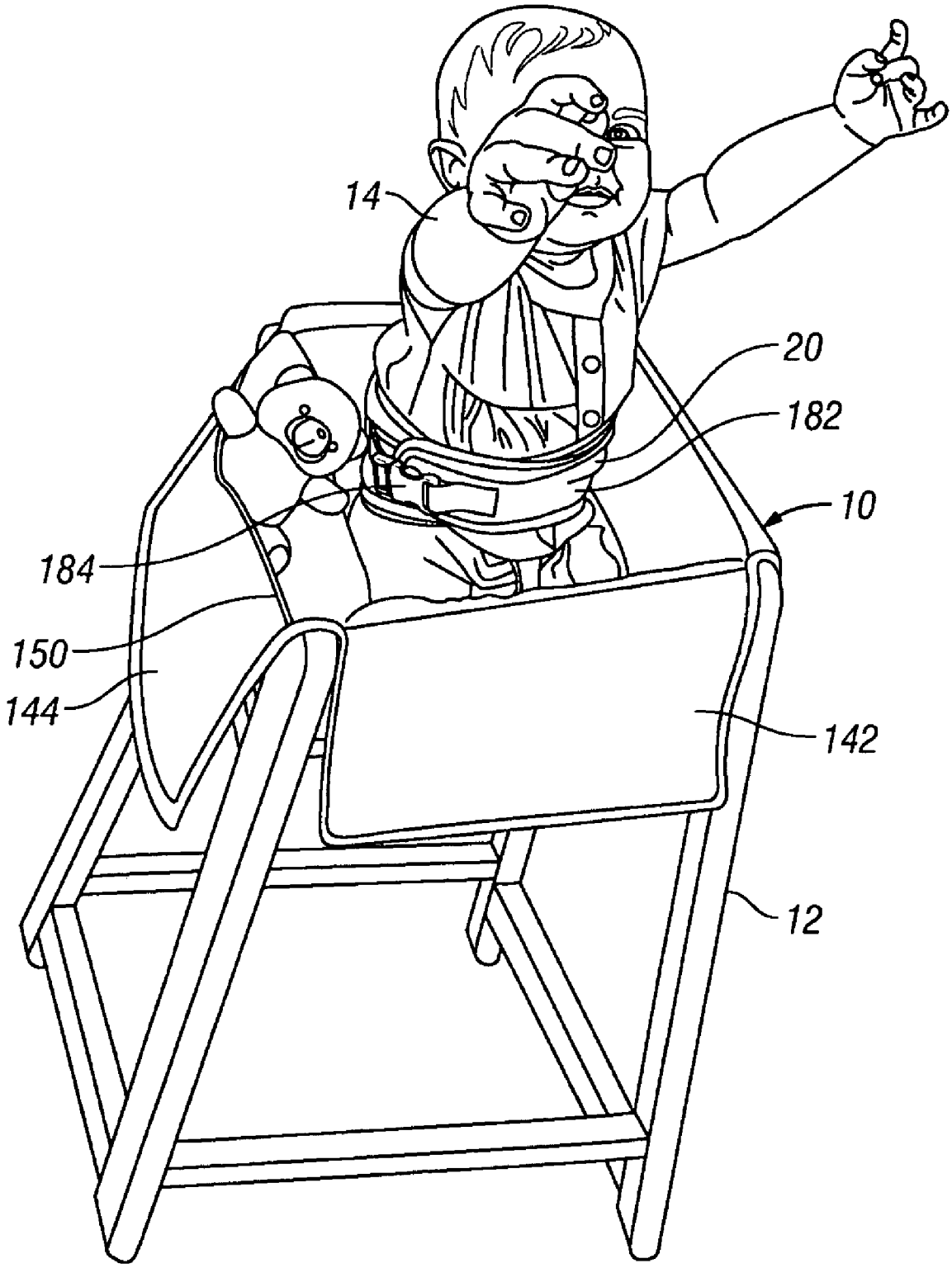
FIG. 1 is a frontal perspective view of a baby seated in a typical high chair. The high chair seat is covered with the seat liner of the present invention, and the body belt is secured around the baby's torso.

Turning now to the drawings in general and to FIG. 1 in particular, there is shown therein a seat liner for a child's seat a made in accordance with a preferred embodiment of the present invention and designated generally by the reference numeral 10. The seat liner 10 is shown positioned inside the seat area of a conventional wooden restaurant high chair 12. A baby 14 is seated in the high chair 12. The baby 14 is secured in the high chair 12 by the liner's restraint assembly 20.

Figure 2:
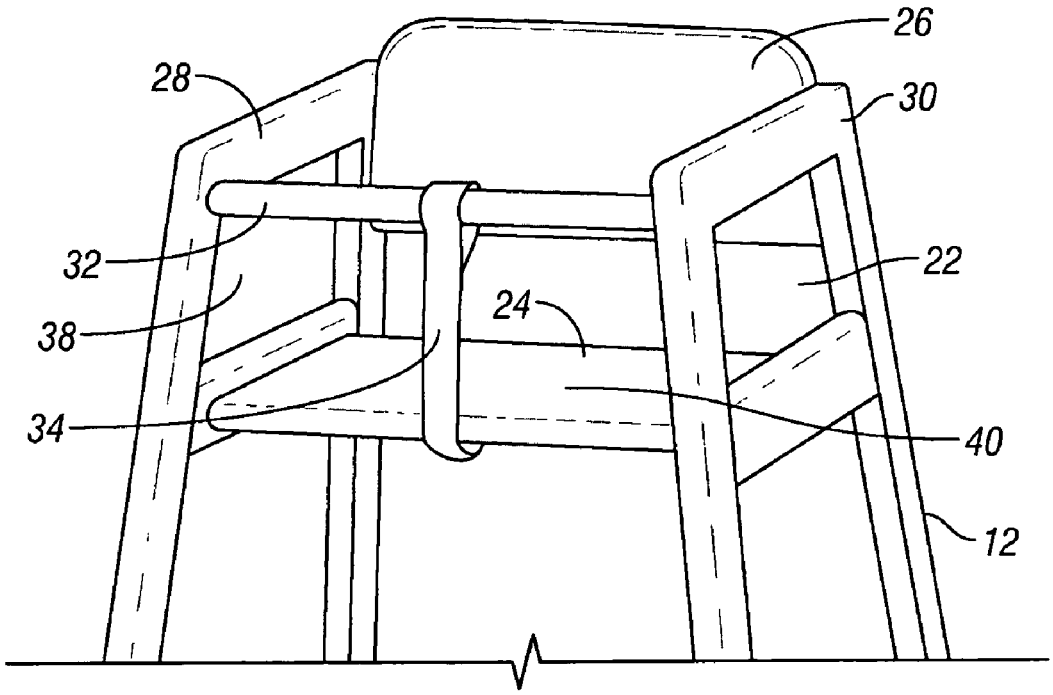
FIG. 2 is a fragmented, frontal perspective view of the upper portion of the high chair seen in FIG. 1.

Although the seat liner 10 is shown herein in use with a high chair, the invention is not so limited. The seat liner 10 may be used with any similarly structured child's seat. The upper seat portion of the high chair 12 is shown in FIG. 2. The seat 22 of the high chair 12 comprises a bottom 24, a back member 26, left and right side members 28 and 30, and a lap bar or other horizontal front member 32. As used herein relative to the seat and the seat liner, the terms "left" and "right" are used merely for convenient description and refer to the viewer's left and right sides. For example, the left side member 28 of the seat 22 is that side on the viewer's left in the FIG. 1.

Most child seats also have a crotch member extending vertically between the bottom 24 and the front member 32 to prevent the child from sliding out of the seat under the lap bar 32. In most high chairs, this takes the form of a fabric crotch strap 34 as shown. However, this may be a rigid bar or other frame member, as is found in conventional grocery carts, for example. The space between the horizontal member and the bottom 24 of the seat 22 defines at least one leg opening.

Where the seat 22 includes a horizontal member, such as the crotch strap in a high chair, there are two separate leg openings 38 and 40.

Figure 8:
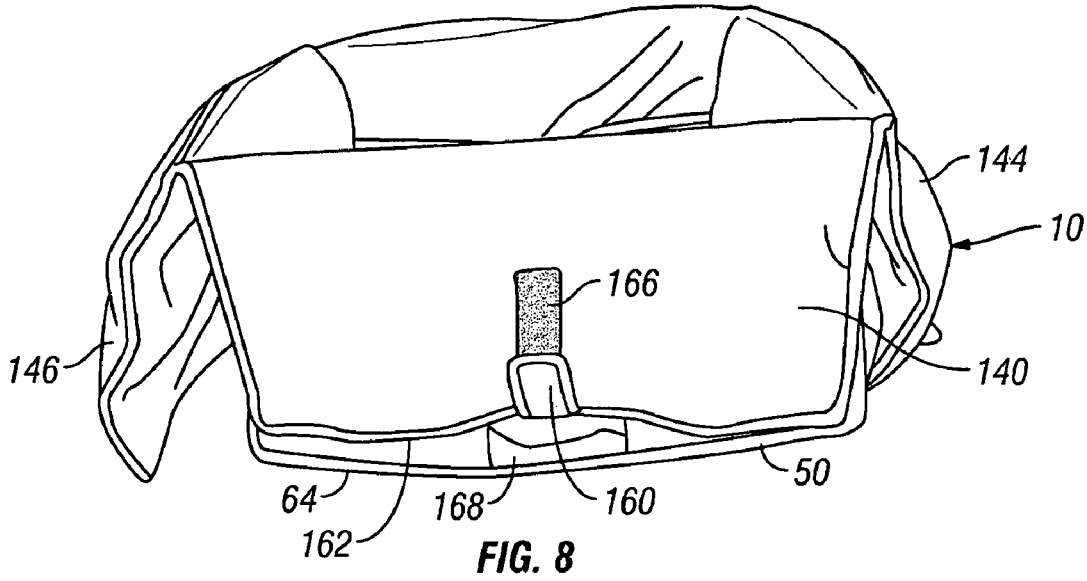
FIG. 8 is a rear perspective view of the seat liner seen in FIG. 1 with the back flap folded down showing the back flap connector tab by which the back flap is secured around the back of the child's seat.
Figure 9:
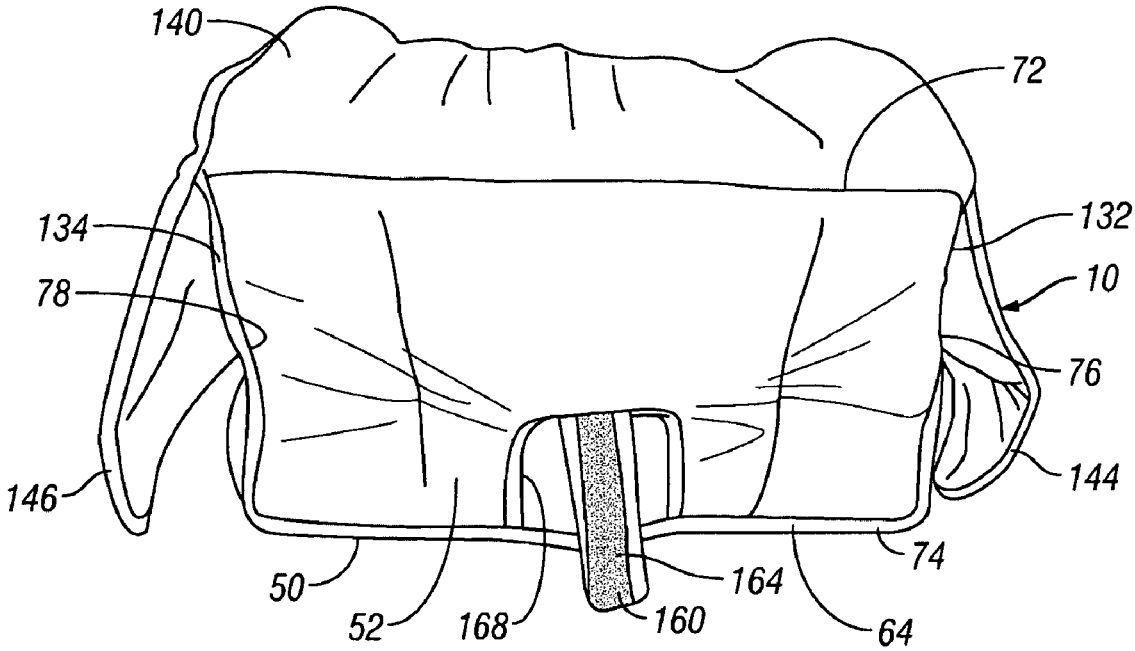
FIG. 9 is a rear perspective view of the seat liner seen in FIG. 7 showing the back flap connector tab released and the back flap lifted.
Figure 10:
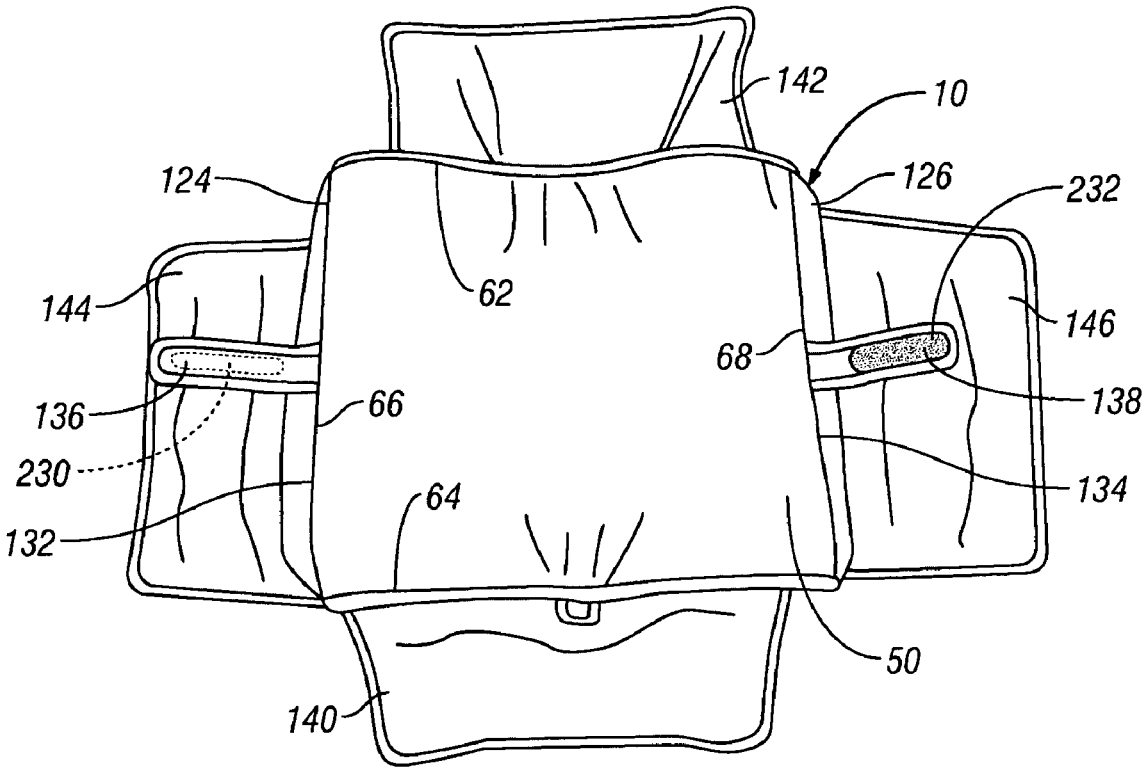
FIG. 10 is bottom view of the of seat liner showing the front, back, and side flaps opened out and the side connector tabs released.

The seat liner 10 is shown apart from the high chair 12 in FIGS. 3-10. The seat liner 10 preferably takes the form of a box or enclosure with an open top. To that end, the preferred embodiment comprises a bottom panel 50, a back panel 52, a front panel 54, and left and right side panels 56 and 58, all of which preferably are rectangular. As best shown in FIG. 10, the bottom panel 50 has a front edge 62, a back edge 64, and left and right side edges 66 and 68.

The back panel 52, seen best in FIG. 9, preferably has an upper edge 72, a lower edge 74 and left and right side edges 76 and 78. The lower edge 74 is attached to the back edge 64 of the bottom panel 50.

Figure 5:
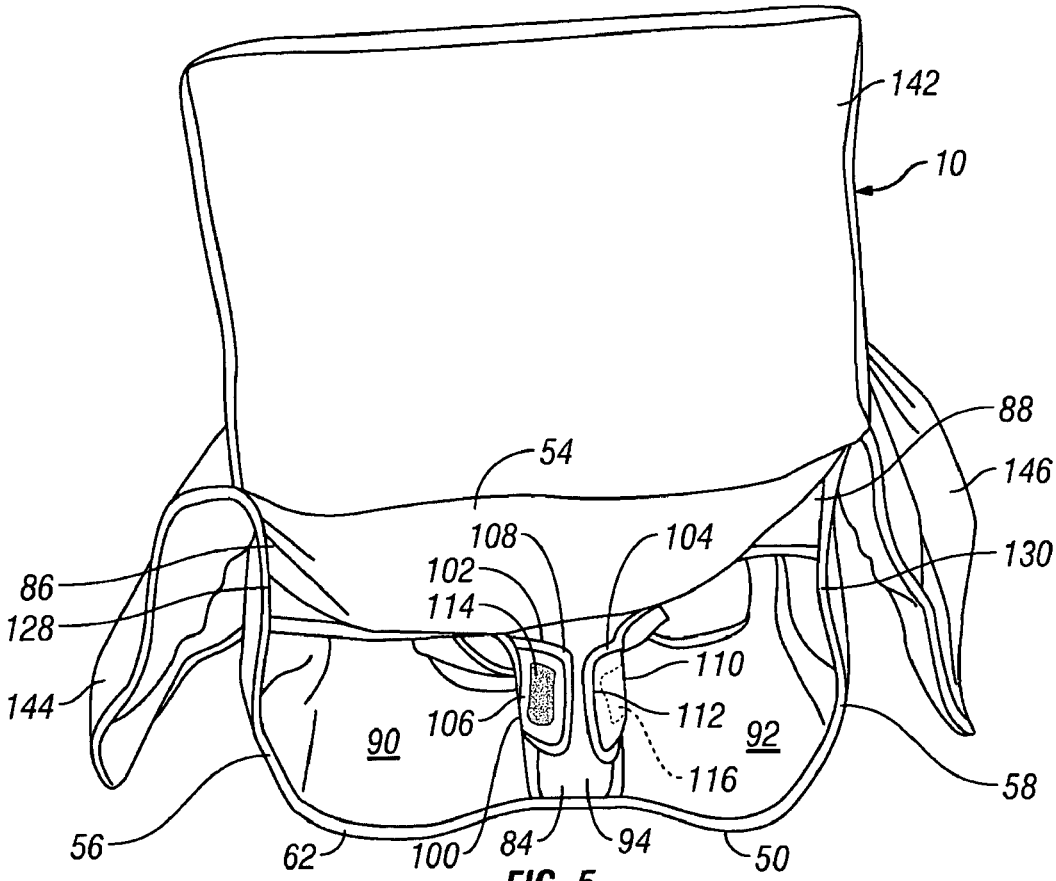
FIG. 5 is a front perspective view of the seat liner seen in FIG. 4 with the front flap lifted to show the leg openings and the crotch connector in the open position.
Figure 6:
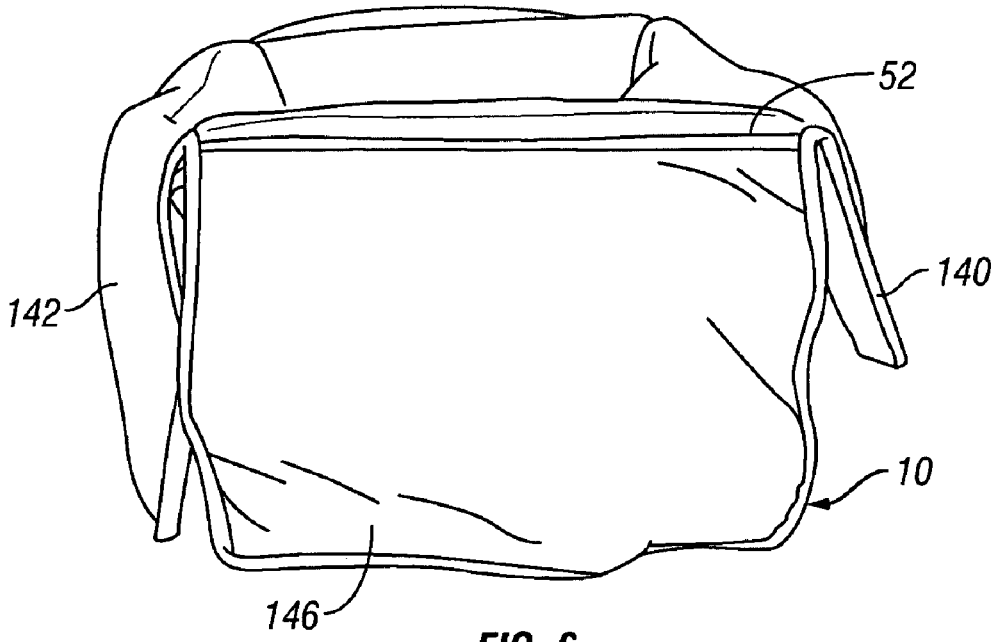
FIG. 6 is a side perspective view of the seat liner seen in FIG. 1 showing the pocket opening along the top edge of the panel.
Figure 7:
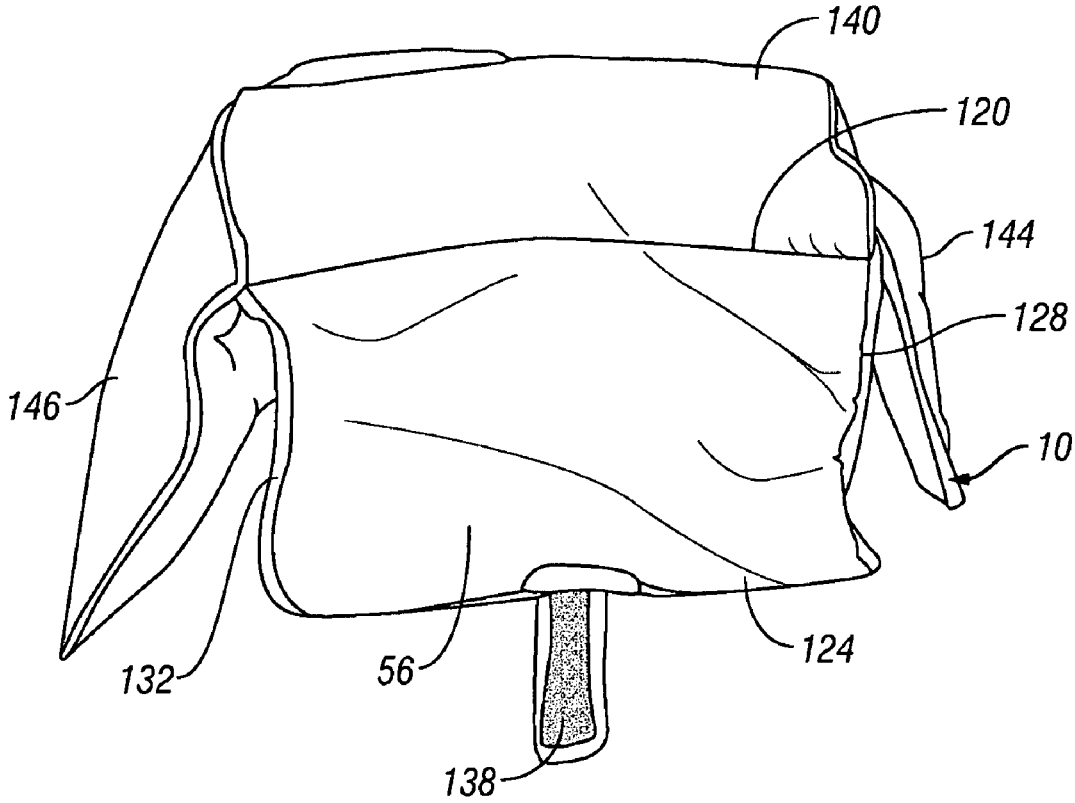
FIG. 7 is a side perspective view of the seat liner seen in FIG. 6 with the side flap lifted to show the side connector tab by which the seat liner is secured in the stowed or transport mode.

The front panel 54, as best shown in FIG. 5, has a top edge 82 (FIG. 3), a bottom edge 84, and left and right side edges 86 and 88. The bottom edge 84 of the front panel 54 is attached to the front edge 62 of the bottom panel 50. The front panel 54 defines at least one leg opening for receiving the legs of the baby 14 or other child sitting in the seat liner 10. More preferably, for reasons that will become apparent, the front panel 54 defines a pair of leg openings 90 and 92, one for each of the baby's legs. To that end, the front panel 54 comprises a divider strip 94.

Referring still to FIG. 5, the seat liner 10 comprises a crotch connector 100 sized and positioned to removably attach the seat liner to the crotch strap 34 or other crotch member of the seat 22. Although the position and configuration of the crotch connector 100 may vary, in the preferred embodiment the crotch connector comprises first and second tabs 102 and 104 fixed to the side edges of the divider strip 94. The first tab 102 has a first end 106 attached to the left side of the divider strip 94 and a free end 108. Similarly, the second tab 104 has a first end 110 attached to the right side of the divider strip 94 and free end 112. The free ends 108 and 110 are connectable to each other and are sized to extend around the crotch member 34 of the seat 22 when the seat liner 10 is positioned in the seat. Most preferably, the free ends 108 and 100 are long enough to over lap each other and the opposing faces are provided with hook-and-loop fasteners indicated at 114 and 116.

Returning briefly to FIG. 3, the left and right side panels 56 and 58 each have a top edge 120 and 122, bottom edges 124 and 126 (FIG. 10), front edges 128 and 130 (FIG. 5), and back edges 132 and 134 (FIG. 9). The bottom edges 124 and 126 are attached to the left and right side edges 66 and 68 of the bottom panel 50. The front edges 128 and 130 are attached to the left and right side edges 86 and 88 of the front panel 54, and the back edges 132 and 134 are attached to the left and right side edges 76 and 78 of the back panel 52. Left and right side connector tabs 136 and 138 (FIG. 10) are sewn into the liner 10 at the seam between bottom edges 124 and 126 of the side panels 56 and 58 and the left and right side edges 66 and 68 of the bottom panel, for a reason to be explained below.

With continuing reference to FIGS. 3-10, in its preferred form, the seat liner further comprises pivotally attached flaps that fold over the seat so as to almost entirely cover the surfaces of the seat that might otherwise contact the baby 14. The flaps may comprise one or more, and most preferably all of the following: a back flap 140, a front flap 142 and left and right side flaps 144 and 146. All the flaps 140, 142, 144 and 146 are rectangular, although the back flap 142 is shorter for a purpose to be described hereafter.

The left and right side flaps 144 and 146 are pivotally attached to the upper edges of the left and right side panels 56 and 58. As seen best in FIGS. 1, 3, and 6, pockets 150 and 152 may be formed in the panels 56 and 58. These pockets will conveniently accommodate bottles, toys, tissues, snacks and the like.

Figure 17:
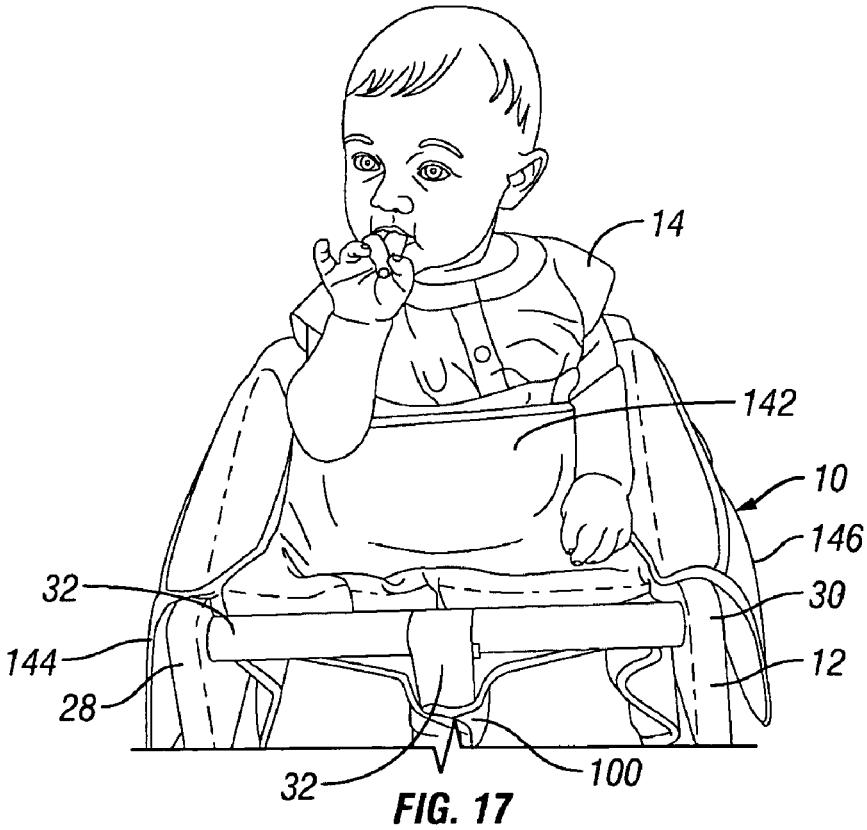
FIG. 17 shows a front perspective view of a child seated in the high chair with the seat liner. The front flap is folded back over the child's torso illustrating how the front flap serves alternately as a crumb catcher.

The front flap 142 is pivotally attached to the upper edge 82 of the front panel 54. The front flap 142 is positionable in a first position folded down towards the front of the front panel so as to at least partially cover the legs of a child sitting in the child's seat with the seat liner in place, as best seen in FIG. 1. Alternately, the front flap is positionable in a second position folded back over the lap of a child sitting in the child's seat with the seat liner in place thereby serving as a crumb catcher. This position is illustrated in FIG. 17.

Referring to FIGS. 8 and 9, another advantageous feature of the inventive seat liner will be described. The seat liner 10 preferably comprises a rear connector, such as tab 160, by which the free edge 162 of the back flap 140 may be attached to the back panel 52. As mentioned previously, the back flap 140 is slightly shorter than the other flaps. In this way, when the seat liner 10 is placed in the high chair seat 22, and the back flap 140 is folded over the back member 26 (FIG. 2) of the chair 12, the back flap will substantially cover the back member but not reach all the way to the bottom panel 50. Most preferably, the rear connector tab 160 is fixed to the back panel 52 a distance above the lower edge 74 of the back panel 52 and slightly above the bottom panel 50.

The tab 160 and the free edge 162 of the back flap 140 are connectable to each other. Preferably, the tab 160 is sized to extend over or overlap the free edge 162 of the back flap 140, and the opposing faces of the tab 160 and back flap 140 are provided with mating hook-and-loop fasteners 164 and 166. In this way, the back flap 140 and the tab 160 are sized to enclose or encircle the back member 26 of the chair 12. This attachment helps keep the seat liner 10 properly positioned in the seat 22.

Referring still to FIGS. 8 and 9, the back panel 52 may be provided with an opening such as the vent hole 168, preferably positioned adjacent the lower edge 74 of the back panel 52 and centered between the left and right side edges 76 and 78 thereof. This opening provides ventilation to the seat liner 10. Additionally, the upper edge of the hole 168 provides a convenient attachment point for the connector tab 160.

Figure 11:
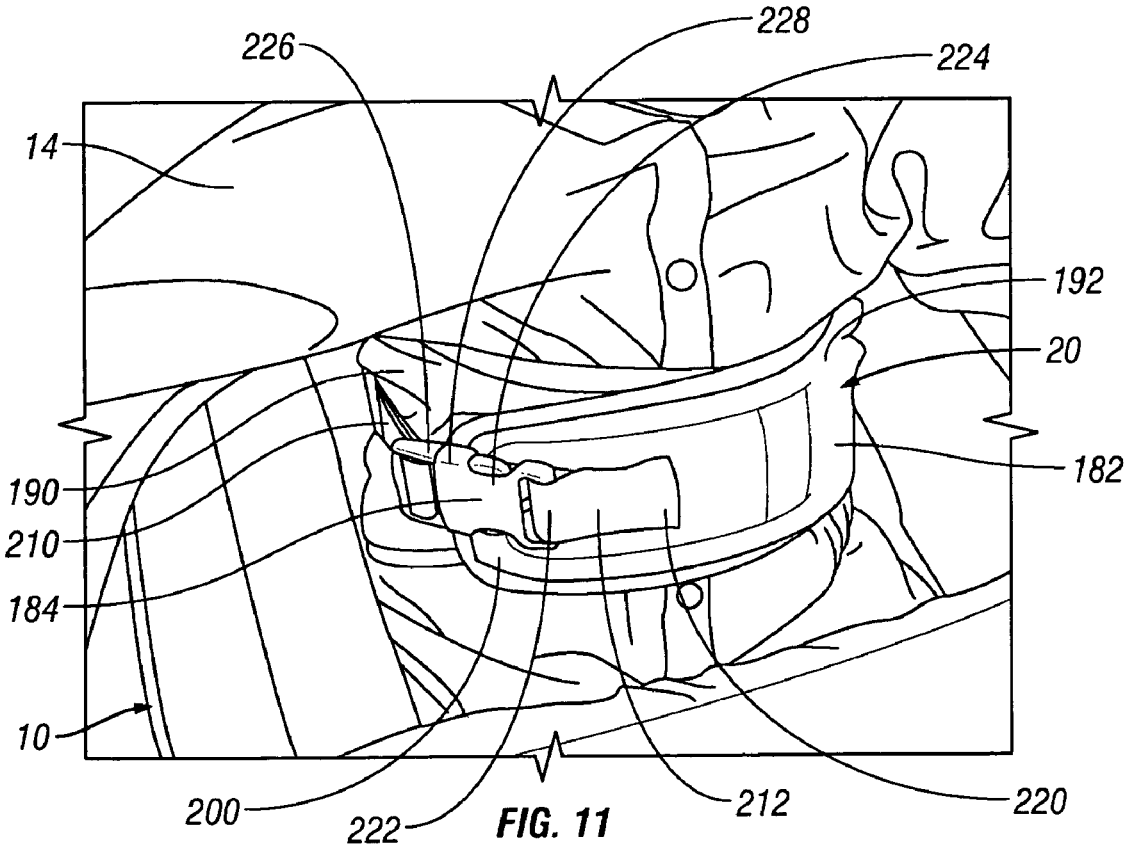
FIG. 11 a fragmented, enlarged, frontal perspective view a child seated in the high chair with the seat liner. The restraint is shown secured snugly around the baby's middle.
Figure 12:
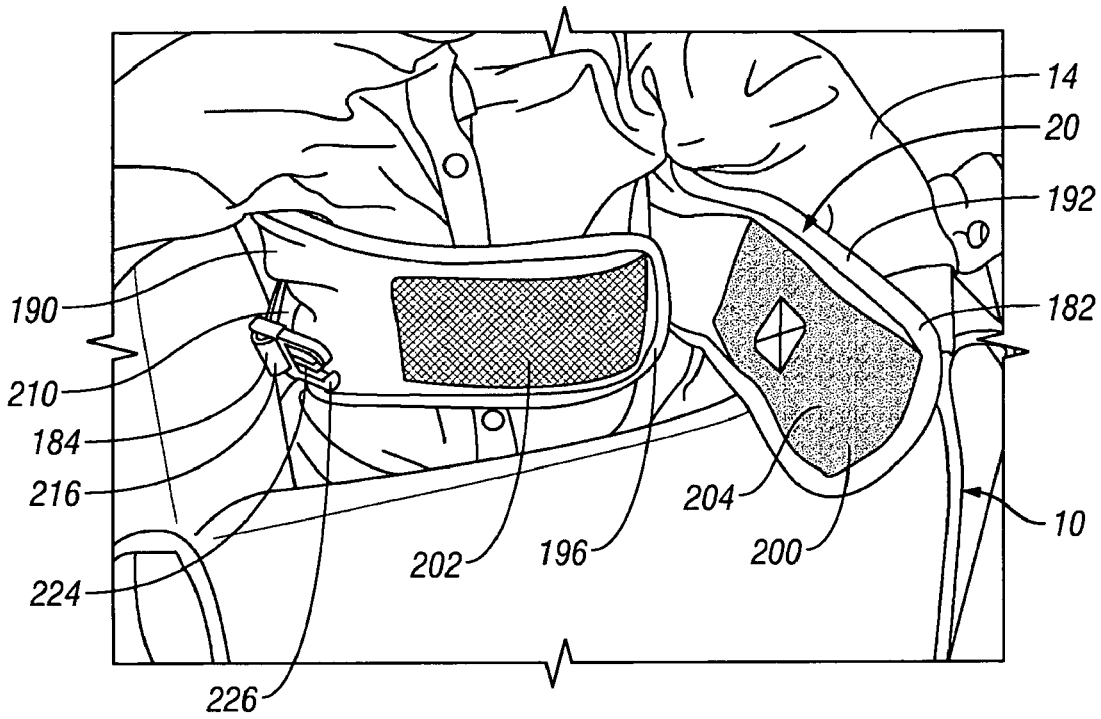
FIG. 12 is a fragmented, enlarged, frontal perspective view a child seated in the high chair with the seat liner. The restraint is shown opened out depicting the hook-and-loop fasteners on the free ends of the belly straps.
Figure 13:
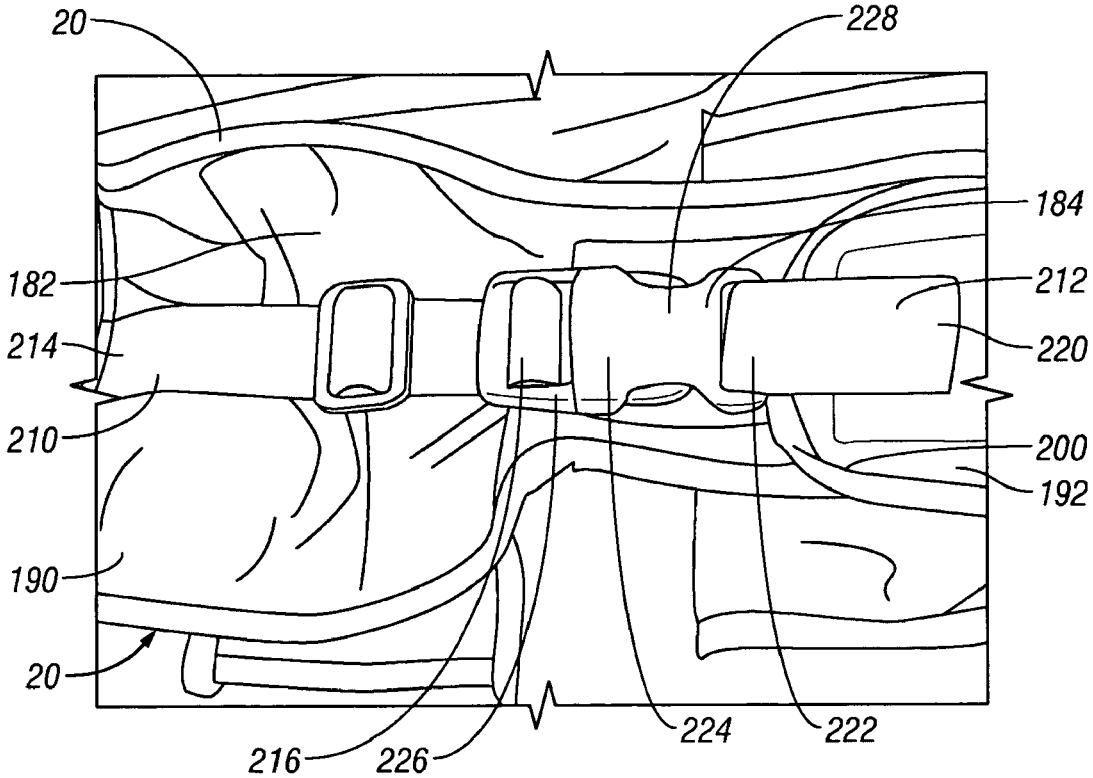
FIG. 13 an enlarged, frontal view of the restraint showing the adjustable, child-resistant safety belt overlying the body belt.

Turning now to FIGS. 11-13, the preferred restraint assembly 20 of the seat liner 10 will be explained. Most high chairs come equipped with seat belts or harnesses of some sort for securing the child in the seat. This belt, which is often fabric, is particularly difficult to clean. In the preferred embodiment, the seat liner 10 of the present invention comes equipped with the restraint assembly 20.

The preferred restraint assembly 20 comprises a wide body belt 182 and a secondary safety belt 184. The body belt 182 is designed to easily and comfortably wrap around the baby's middle torso using hook-and-loop fasteners. The hook-and-loop fasteners are highly adjustable and flexible and are, therefore, ideal for this application. However, some older infants may have developed the motor skills to pull apart hook-and-loop fasteners. The safety belt 184 makes such a catastrophe less likely.

Figure 3:
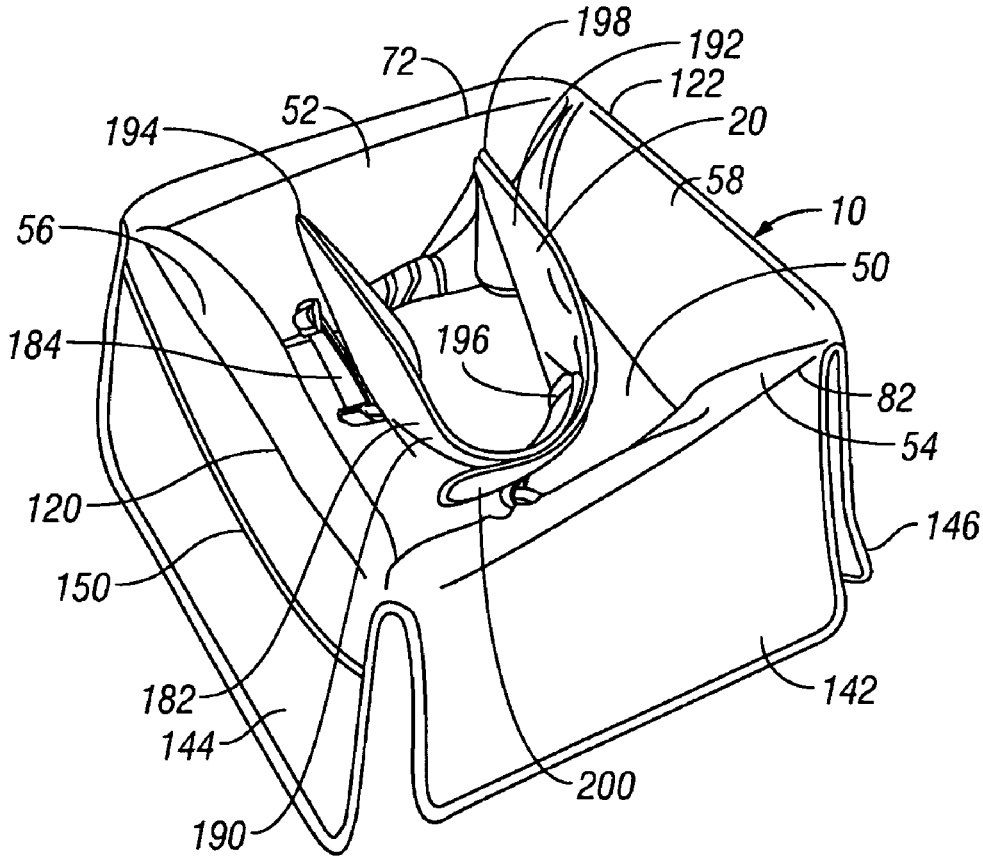
FIG. 3 is a top perspective view of the seat liner seen in FIG. 1.
Figure 4:
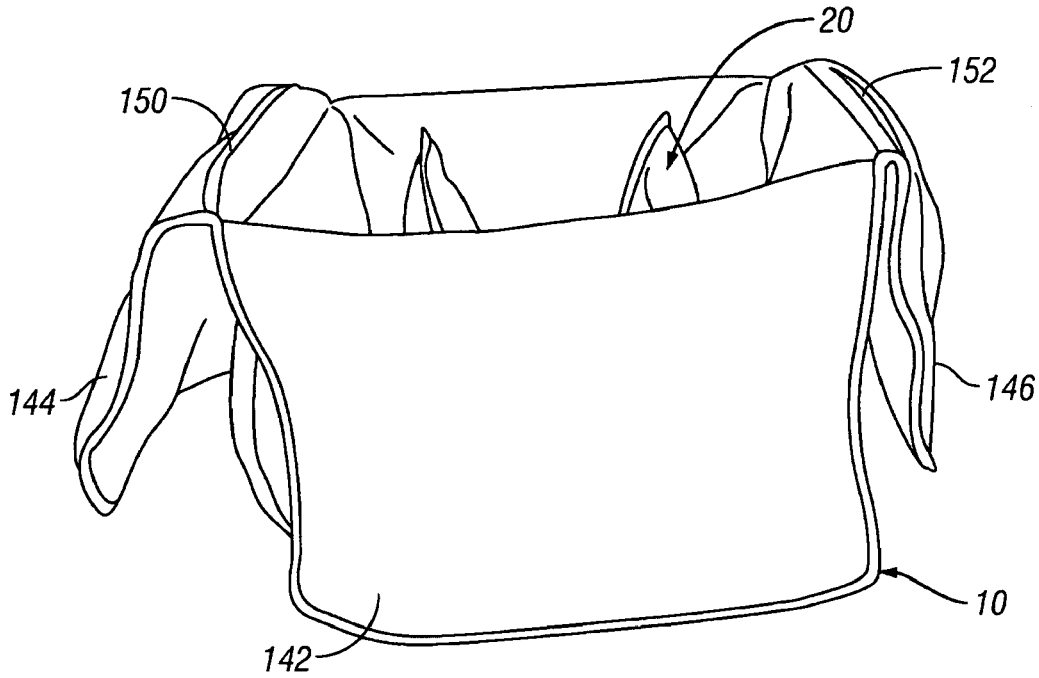
FIG. 4 is a front perspective view of the seat liner seen in FIG. 1.

As seen best in FIGS. 3, 11, and 12, the body belt 182 preferably comprises two body straps 190 and 192. As FIG. 3 shows, the left strap 190 has a first end 194 and a second free end 196. The right body strap 192 has a first end 198 and a second, free end 200. The first ends 194 and 198 are attached to the inside of the back panel 52 (FIG. 3). The free ends 196 and 200 are sized to adjustably overlap each other. Mating hook-and-loop fasteners 202 and 204 are fixed on the opposing surfaces of the free ends 196 and 200 (FIG. 12).

While the shape and size of the body belt 182 may vary, it is highly preferred that the body belt be relatively wide. This will allow a more snug fit, much like a cummerbund, and will also tend to keep the baby 14 aligned in an upright position. Preferably, the body straps 190 and 192 have a width of between about 1 inch and about 8 inches. More preferably, the width of the straps 190 and 192 is between about 2 inches and about 6 inches. Most preferably, the straps 190 and 192 are wider at the back and gradually decrease toward the front or free ends 196 and 200. That is, the width of the straps 190 and 192 gradually decreases from the first end 194 and 198 at the back to the second, free ends 196 and 200. In the most preferred embodiment, the straps 190 and 192 are about 5 inches at the first ends 194 and 198 and taper to about 3 inches at the free ends 196 and 200.

As best shown in FIG. 12, the width of the hook-and-loop fasteners 202 and 204 is nearly as wide as the free ends 196 and 200, that is, the fastener material is at least half the width of the free ends 196 and 200. More preferably, the fastener material is at about two-thirds of the width of the free ends 196 and 200.

With continuing reference to FIGS. 11-13, the safety belt 184 will be described. While the safety belt 184 may be totally separate from the body belt 182, it is most convenient to attach it to the surface of the body belt. To that end, the safety belt 184 comprises a first strap 210 and a second strap 212. The first strap 210 has a first end 214 attached to the first strap 190 and a second free end 216. The second strap 212 has a first end 220 attached to the second strap 192 and a second, free end 222. Two mating components of a child-resistant connector are attached to the free ends 216 and 220 of the safety belt 184. As shown herein, the connector is a side-release buckle 224. These are widely available in plastic and in many colors are sufficiently difficult for very small children to manipulate that inadvertent release is unlikely. The male end 226 of the buckle 224 is attached to the free end 216 of the strap 190, and the female end 228 of the buckle is attached to the free end 222 of the second strap 192.

As used herein, "child-resistant connector" denotes a connector that is more difficult for a small child to open than for an adolescent or adult. Suitable connectors include ladder lock buckles, center and side release buckles, cam buckles, and snap hooks. It should be noted that the issue is the small child's ability to release the connector and not whether a small child can easily engage the connector. Accordingly, connectors that are released by simple pushing or pulling actions are excluded from this definition. Examples of such easily released connectors are simple, overlapping straps with hook-and-loop fasteners (similar to that used on the body belt), snaps and ties.

The seat liner 10 may be formed from any of a variety of fabrics, but usually a fabric that is both washable and durable is preferred. Suitable fabrics include but are not limited to waterproof nylon, flannel, or elastic fabrics, such as spandex or cotton-spandex blends. However, presently a polyester/cotton blend is preferred. A particularly preferred fabric is polyester plush material. The various panels and flaps forming the seat liner may be constructed by sewing two similarly shaped pieces of material together, perhaps with decorative cording at the seams and edges. Batting or another compressible layer may be inserted between the two layers.

Figure 14:
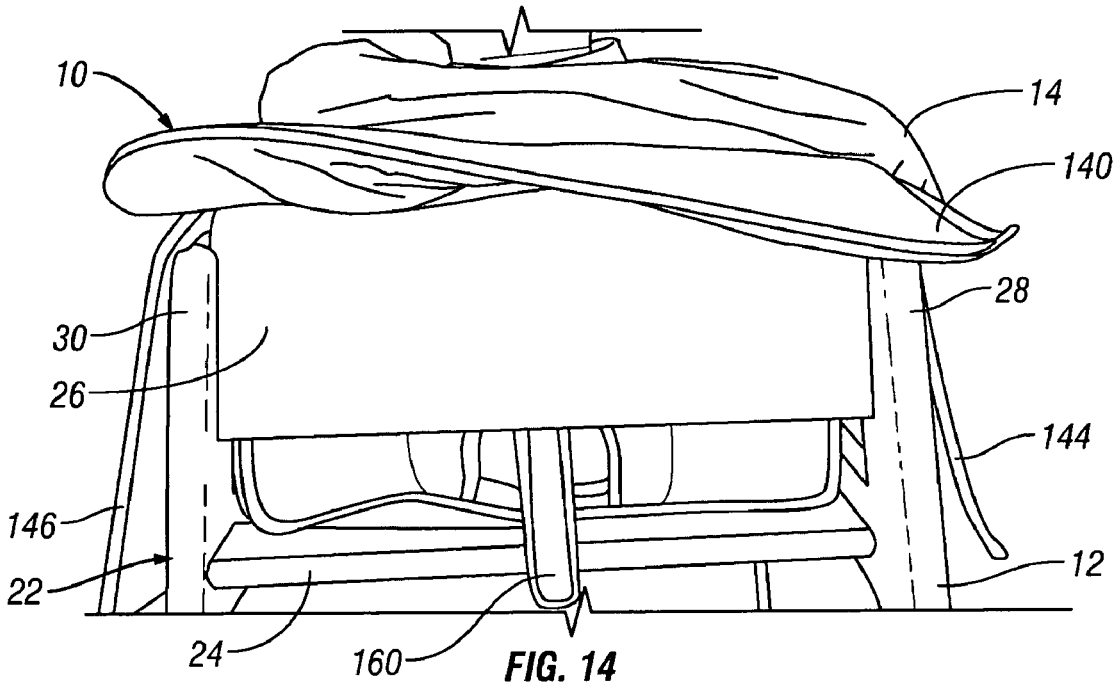
FIG. 14 is rear view of the seat liner placed in a high chair with the back flap lifted to show the back of the high chair.
Figure 15:
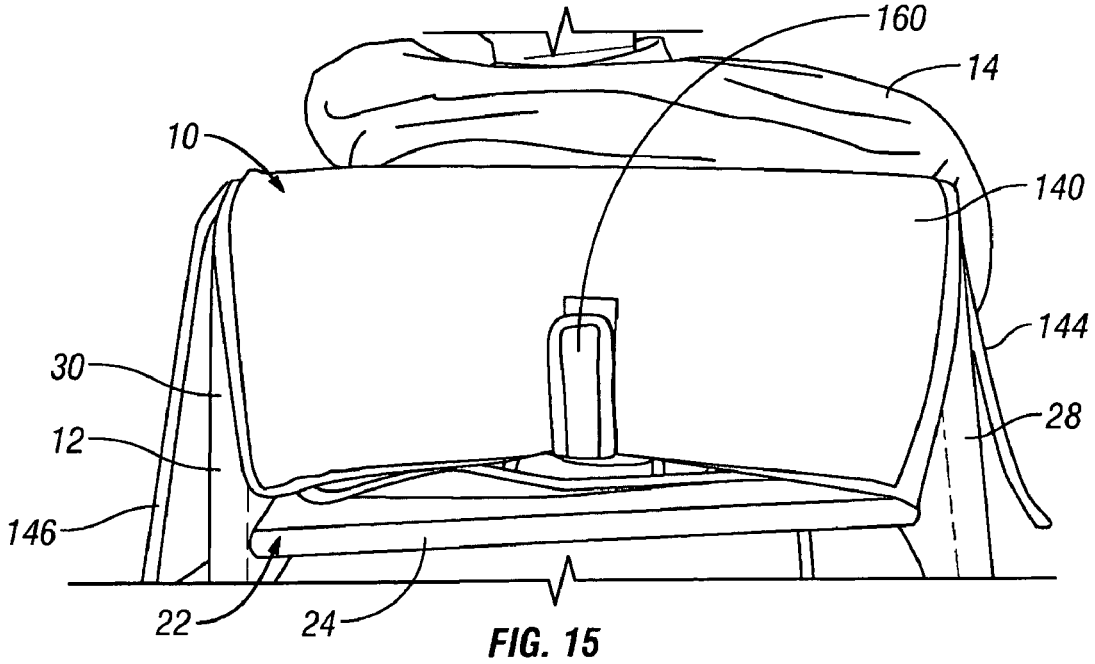
FIG. 15 is rear view of the seat liner in the high chair as seen in FIG. 14 with the back flap folded down and the back connector tab attached back flap securing the seat liner to the back of the high chair.
Figure 16:
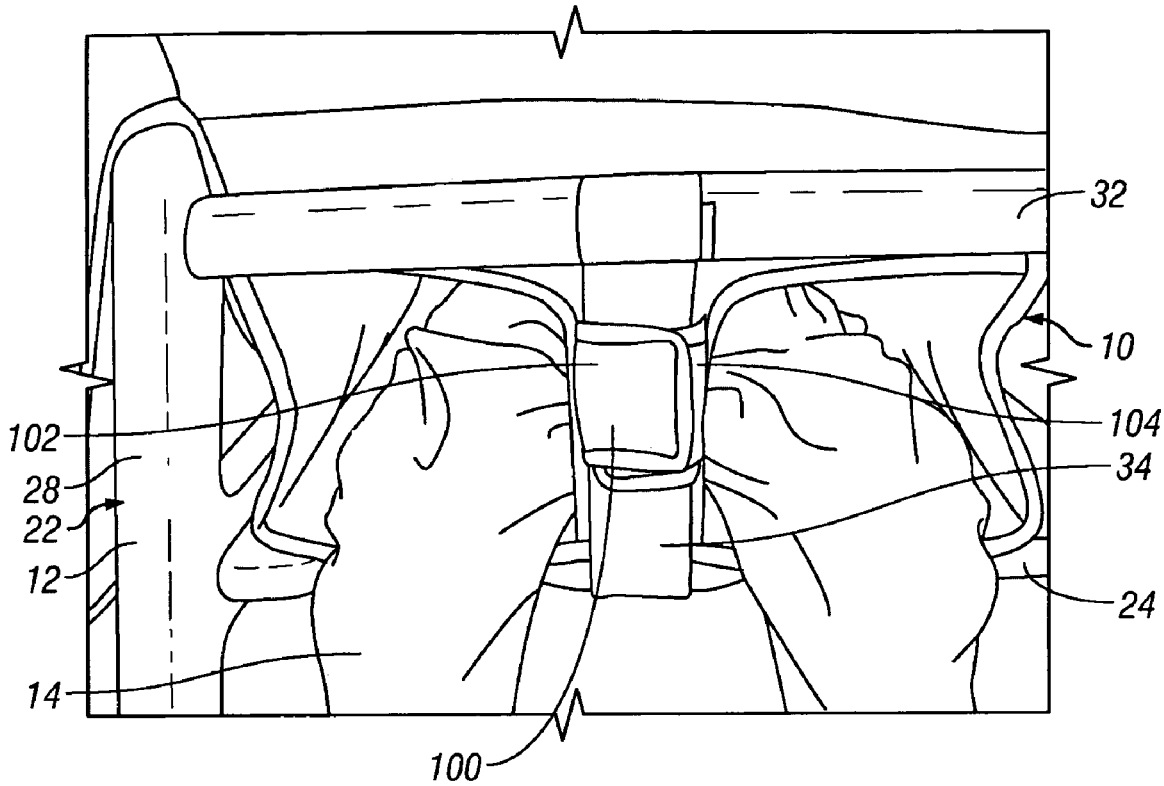
FIG. 16 is a front view of a child seated in the high chair with the seat liner. The front flap is lifted to reveal the child's legs extending through the leg openings and the overlapping tabs of the crotch connector secured around the crotch strap of the high chair.

Having described the preferred seat liner 10, its use will be explained. First the seat liner 10 is opened up and placed inside the seat 22 of the high chair 12 or other child's seat, as seen in FIG. 1. The back, front, side flaps 140, 142, 144 and 146, are folded out over the lap bar 32, side rails 28 and 30, and back member 26 of the chair 12 (FIG. 2). As shown in FIGS. 14 and 15, the rear connector strap 160 is pulled through the back of the chair 12 under the back member 26 and secured to the back flap 140. Next, while holding the front flap 142 out of the way, the crotch connector 100 is secured around the crotch strap 32 of the chair 12, as shown in FIGS. 16 and 17. The front flap 142 may be left in the crumb catcher position shown in FIG. 17, or folded back down over the front of the chair 12.

Figure 18:
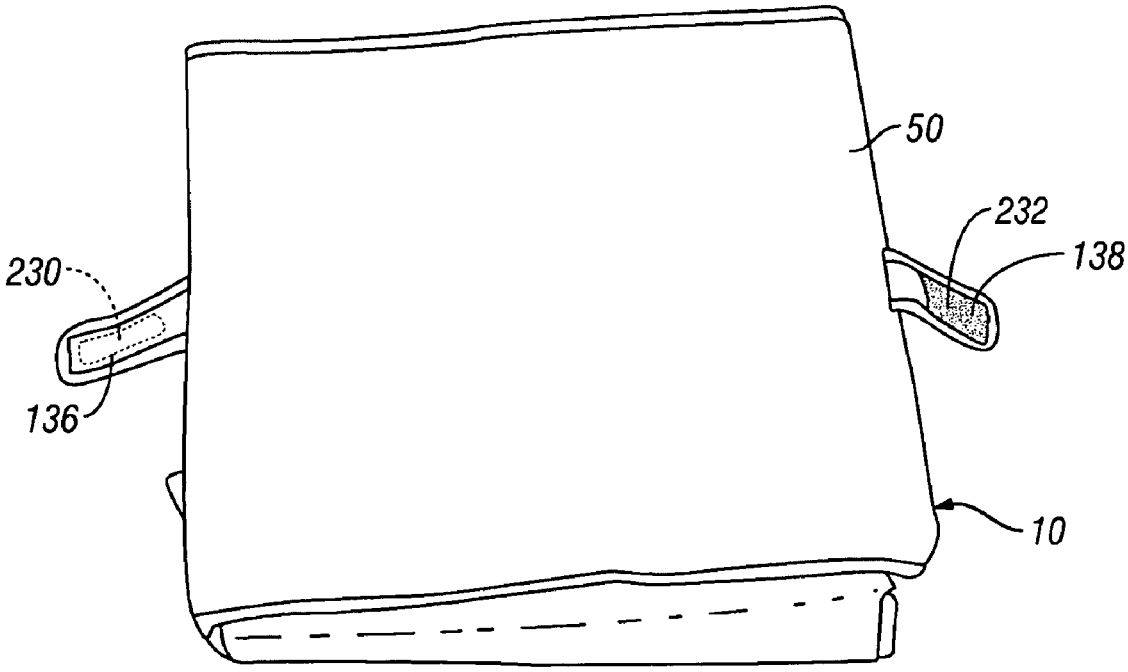
FIG. 18 shows a bottom perspective view of the seat liner folded in on itself with the side connector tabs extending outwardly.
Figure 19:
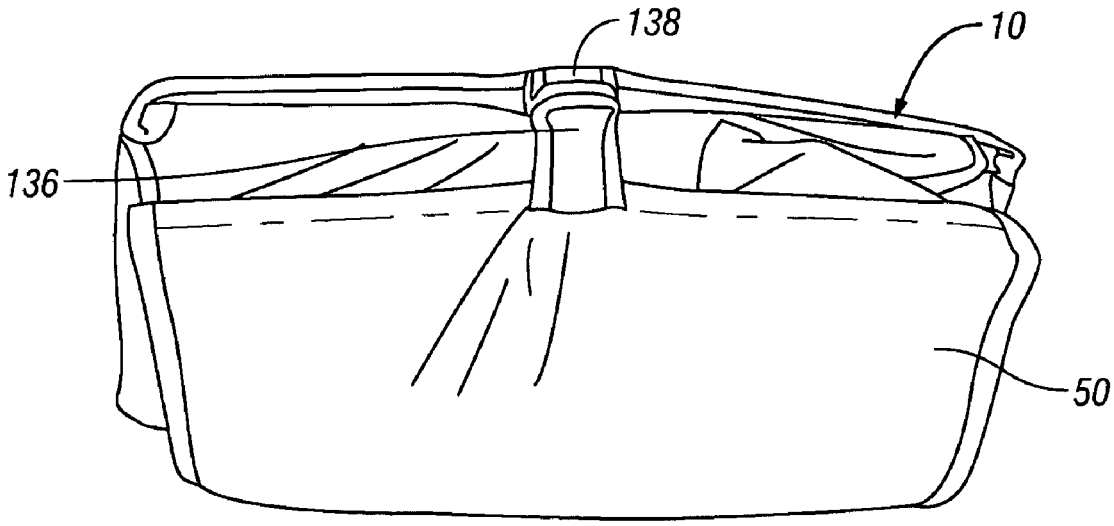
FIG. 19 shows a perspective view of the seat liner in the fully stowed position wherein the collapsed seat liner has been folded in half and the side connector tabs overlapping securing the seat liner in the stowed or transport mode.

Before and after use of the seat liner 10 as previously described, it may be collapsed and secured in a storage or travel mode, as shown in FIGS. 18 and 19. First, the panels and flaps of the liner are collapsed and folded together on the top side of the bottom panel 50, as seen in FIG. 18. Then, the collapsed liner 10 is folded in half so that the side connector tabs 136 and 138 can be overlapped. The tabs 136 and 138 are provided with connectors of some sort, such as hook-and-loop fasteners 230 and 232, although virtually any other type of connector may be substituted. With the tabs 136 and 138 secured, tightly stowing the liner in the folded, collapsed position, the liner 10 may be carried using the overlapping tabs as a handle or, alternately, stowed for travel or storage.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A seat liner for a child's seat, the seat comprising a bottom, a back member, left and right side members, a horizontal front member extending between the left and right side members, and a crotch member extending vertically between the bottom and front member forming a pair of leg openings in the seat, the seat liner comprising:

a bottom panel with a back edge, a front edge, and left and right side edges;

a back panel with an upper edge, left and right side edges, and a lower edge, the lower edge attached to the back edge of the bottom panel, wherein the back panel includes a vent hole adjacent the lower edge of the back panel and centered between the left and right edges of the back panel;

a back flap pivotally attached to the upper edge of the back panel;

left and right side panels, each having an upper edge, front and back edges, and a bottom edge, the bottom edges of the left and right panels attached to the left and right side edges, respectively, of the bottom panel, and the back edges attached to the left and right side edges of the back panel;

a front panel having an upper edge, a bottom edge, and left and right edges, the bottom edge attached to the front edge of the bottom panel, the left and right side edges attached to the front edges of the left and right side panels, respectively, and wherein the front panel includes at least one leg opening; and a rear connector tab adapted to attach the outer edge of the back flap to the back panel, and wherein the back flap and rear connector tab are sized to enclose the back member of the seat when the seat liner is positioned in the child's seat, the rear connector tab extending from the back panel a distance above the lower edge and sized to overlap the outer edge of the back panel, and wherein the rear connector tab extends from the top of the vent hole.

2. The seat liner of claim 1 wherein the front, back, left, right and bottom panels are rectangular.

3. The seat liner of claim 2 further comprising a front flap pivotally attached to the upper edge of the front panel, a back flap pivotally attached to the upper edge of the back panel, and left and right side flaps pivotally attached to the upper edges of the left and right side panels, respectively.

4. The seat liner of claim 1 wherein the at least one leg opening comprises a pair of leg openings divided by a center divider strip.

5. The seat liner of claim 1 further comprising a front flap pivotally attached to the upper edge of the front panel, wherein the front flap is positionable in a first position folded down towards the front of the front panel so as to at least partially cover the legs of a child sitting in the child's seat with the seat liner in place, and wherein the front flap is positionable in a second position folded back over the lap of a child sitting in the child's seat with the seat liner in place thereby serving as a crumb catcher.

6. The seat liner of claim 1 further comprising left and right side flap pivotally attached to the upper edge of the left and right side panels, respectively, wherein the side panels are sized to fold over and cover the left and right side members of the child's seat.

7. The seat liner of claim 6 wherein each of the side panels defines a pocket.

8. The seat liner of claim 1 further comprising a crotch connector sized and positioned to removably attach the seat liner to the crotch member of the seat.

9. The seat liner of claim 8 wherein the crotch connector is fixed to the divider strip on the front panel.

10. The seat liner of claim 9 wherein the crotch connector comprises first and second tabs each having a first end attached to the divider strip and a second, free end, the free ends of the first and second tabs being connectable to each other and sized to extend around the crotch member of the seat when the seat liner is positioned in the seat.

11. The seat liner of claim 10 wherein the free ends of the crotch connector tabs are long enough to over lap each other and wherein the opposing surfaces of the overlappable free ends are provided with mating hook-and-loop fasteners.

12. The seat liner of claim 1 wherein the opposing surfaces of the rear connector tab and the back panel are provided with mating hook-and-loop fasteners.

13. The seat liner of claim 1 wherein the rear connector tab extends from the top of the vent hole.

14. The seat liner of claim 1 wherein the seat liner is washable.

15. The seat liner of claim 1 further comprising a restraint assembly adapted to secure the child in the seat liner when the seat liner is positioned in the child's seat.

16. The seat liner of claim 15 wherein the restraint assembly comprises a body belt sized and positioned to encircle the torso of a child sitting in the seat with the liner positioned in the seat and to support the child in an upright position.

17. The seat liner of claim 16 wherein the body belt comprises two body straps, each having a first end and a second, free end, the first ends being attached to the inside of the back panel, and the free ends being sized to adjustably overlap each other, and wherein the body belt further comprises mating hook-and-loop fasteners on the opposing surfaces of the overlappable free ends.

18. The seat liner of claim 17 wherein the width of each of the body straps is between about 1 inch and about 8 inches.

19. The seat liner of claim 18 wherein the width of each of the body straps is between about 2 inches and about 6 inches.

20. The seat liner of claim 19 wherein the width of the each of the body straps decreases from the first end to the second end.

21. The seat liner of claim 20 wherein the width of the second end of each of the body straps is about 5 inches and the width of the each of the free ends is about 3 inches.

22. The seat liner of claim 21 wherein the width of the hook-and-loop fasteners on the opposing surfaces of the overlappable free ends of the body straps is nearly as wide as the free ends.

23. The seat liner of claim 19 wherein the restraint assembly further comprises a child resistant connector.

24. The seat liner of claim 23 wherein the child resistant connector comprises a side release buckle.

25. The seat liner of claim 23 wherein the at least one leg opening in the front panel comprises a pair of leg openings divided by a center divider strip, wherein the seat liner further comprises a crotch connector sized and positioned to removably attach the seat liner to the crotch member of the seat fixed to the divider strip on the front panel, wherein the crotch connector comprises first and second tabs each having a first end attached to the divider strip and a second, free end, the free ends of the first and second tabs being connectable to each other and sized to extend around the crotch member of the seat when the seat liner is positioned in the seat.

26. A seat liner for a child's seat, the seat comprising a bottom, a back member, left and right side members, and a horizontal front member extending between the left and right side members, the seat liner comprising:

a bottom panel with a back edge, a front edge, and left and right side edges;

a back panel with an upper edge, left and right side edges, and a lower edge, the lower edge attached to the back edge of the bottom panel;

left and right side panels, each having a top edge, front and back edges, and a bottom edge, the bottom edges attached to the left and right side edges, respectively, of the bottom panel, and the back edges attached to the left and right side edges, respectively, of the back panel;

a front panel having a top edge, a bottom edge, and left and right edges, the bottom edge attached to the front edge of the bottom panel, the left and right edges attached to the front edges of the left and right side panels, respectively, and wherein the front panel includes at least one leg opening; and a restraint assembly comprising:

a body belt comprising first and second body straps, each having a width and a first end and a second end, the first ends extending from a front surface of the back panel a distance from both the top and bottom edges and from both the left and right side edges, the second ends being connectable to each other, the first and second body straps sized and positioned to encircle the torso of a child seated in the seat;

a safety belt overlying the connectable second ends of the first and second body straps when the body straps are encircling a child in the seat, the safety belt having a width and comprising first and second ends adjustably connectable by a child-resistant connector; and wherein the width of the body straps is greater than the width of the safety belt.

27. The seat liner of claim 26 wherein the width of each of the body straps is between about 1 inch and about 8 inches.

28. The seat liner of claim 27 wherein the width of each of the body straps is between about 2 inches and about 6 inches.

29. The seat liner of claim 28 wherein the width of the each of the body straps decreases from the first end to the second end.

30. The seat liner of claim 29 wherein the width of the second end of each of the body straps is about 5 inches and the width of the each of the free ends is about 3 inches.

31. The seat liner of claim 30 wherein the width of the hook-and-loop fasteners on the opposing surfaces of the overlappable free ends of the body straps is nearly as wide as the free ends.

32. The seat liner of claim 28 wherein the child resistant connector comprises a side release buckle.

33. The seat liner of claim 26 wherein the front, back, left, right and bottom panels are rectangular.

34. The seat liner of claim 33 further comprising a front flap pivotally attached to the upper edge of the front panel, a back flap pivotally attached to the upper edge of the back panel, and left and right side flaps pivotally attached to the upper edges of the left and right side panels, respectively.

35. The seat liner of claim 34 wherein each of the side panels defines a pocket.

36. The seat liner of claim 26 further comprising a back flap pivotally attached to the upper edge of the back panel.

37. The seat liner of claim 36 wherein the free edge of the back flap is attachable to the back panel, and wherein the back flap is sized to enclose the back member of the seat when the seat liner is positioned in the child's seat.

38. The seat liner of claim 37 wherein the back panel comprises a rear connector tab extending from the back panel a distance above the bottom edge and wherein the rear connector tab is sized to overlap the outer edge of the back panel, wherein the opposing surfaces of the rear connector tab and the back panel are provided with mating hook-and-loop fasteners.

* * * * *